United States Patent [19]

Skeie

[11] Patent Number: 4,593,773

[45] Date of Patent: Jun. 10, 1986

[54] WELL DRILLING ASSEMBLY

[75] Inventor: Bjarne E. Skeie, Kristiansand, Norway

[73] Assignee: Maritime Hydraulics A.S., Kristiansand S, Norway

[21] Appl. No.: 609,883

[22] Filed: May 14, 1984

[30] Foreign Application Priority Data

Jan. 25, 1984 [NO] Norway ..... 840285

[51] Int. Cl.[4] ..... E21B 19/06; E21B 19/00

[52] U.S. Cl. ..... 175/85; 175/170; 175/162; 166/77.5

[58] Field of Search ..... 175/170, 85, 162; 166/77.5; 173/40, 42, 43, 44, 147

[56] References Cited

U.S. PATENT DOCUMENTS

| | | | |
|---|---|---|---|
| 3,766,991 | 10/1973 | Brown | 175/85 X |
| 3,776,320 | 12/1973 | Brown | 175/85 X |
| 3,857,450 | 12/1974 | Guier | 175/85 |
| 4,214,639 | 7/1980 | Anderson | 173/43 X |
| 4,421,179 | 12/1983 | Boyadjieff | 175/85 X |
| 4,449,596 | 5/1984 | Boyadjieff | 175/85 X |
| 4,458,768 | 7/1984 | Boyadjieff | 175/85 X |
| 4,489,794 | 12/1984 | Boyadjieff | 166/77.5 X |

FOREIGN PATENT DOCUMENTS

| | | | |
|---|---|---|---|
| 47809 | 9/1978 | U.S.S.R. | 175/85 |

*Primary Examiner*—James A. Leppink
*Assistant Examiner*—David J. Bagnell
*Attorney, Agent, or Firm*—Cushman, Darby & Cushman

[57] ABSTRACT

A well drilling assembly of the type in which a rotary device is attached to a drawworks, for example to the hoisting hook on a derrick, to which rotary device a hollow shaft is coupled, having a threaded end which is adapted for connection to a complementary threaded end on the drill string, and wherein a clamping/lifting means known as an elevator is suspended below the rotary device by two hanger struts. The shaft connected to the rotary device is telescopic. Outside the shaft a lifting means is provided for the lower part of the telescopic shaft. The two hanger struts which carry the elevator for one end of the pipe are means of a sliding holder known as a link hanger. The link hanger is axially movable by means of hydraulic cylinders.

The lifting means for the lower part of the telescopic shaft consists of hydraulic cylinders which are constructed as a unit together with the hydraulic cylinders, the cylinders constituting piston rods for the hydraulic cylinders.

11 Claims, 10 Drawing Figures

WELL DRILLING ASSEMBLY

The present invention relates to a well drilling assembly of the type in which a motor-driven rotary device is attached to a drawworks, for example to the hoisting hook of the derrick drawworks, wherein a shaft is connected to the rotary device, one end of the shaft having threads adapted for connection to an end of the drill string having complementary mating threads, and wherein a clamping/lifting device known as the elevator is suspended from the rotary device by two struts or links.

On the type of drilling equipment utilized most frequently today, a rotatable, polygonal pipe, known as a kelly, is suspended from the hoist hook above a drilling mud swivel. The lower end of the kelly has threads which mate with complementary threads on the upper end of the drill string. The kelly is rotated by means of a rotary table and gradually moves axially in relation to the rotary table as the drill bit descends. A drawback of this system is that it can handle only a single, 30-foot section of drill pipe at a time. This means that when new drill pipe needs to be added to the string during drilling, a single length of 30-foot-long drill pipe must be stabbed and screwed into the last pipe on the drill string and the upper end of the new pipe attached to the kelly. This is a relatively time-consuming procedure, especially considering that new drill pipe must be added to the string several times an hour. On the other hand, when the drill string makes a trip, i.e., when it is pulled up and then lowered down into the well again, the drill string is divided into sections consisting of three lengths of pipe, called a stand, which are stored in racks as the pipe stands are hoisted up from the well and uncoupled from the rest of the drill string. The drill pipe is thus stored in stands of three pipe sections (90 feet total length) in the pipe rack. It can easily be seen that substantial savings of time and money could be obtained by utilizing a stand-type procedure when adding new pipe to the drill string, which would reduce the number of operations to one-third.

On a more modern, prior art drilling assembly, the rotary device itself is attached to the drawworks on the derrick. The rotary device turns a shaft which is rotatably suspended from the drilling mud swivel. With this equipment, an entire pipe stand consisting of three sections of pipe of 90 feet total length can be connected to the upper end of the drill string. This obviously saves both time and work. A big drawback of this assembly, however, is that it is not possible, at least not without special, time-consuming modifications, to utilize it for a trip, i.e., for hoisting up the entire drill string from the well and lowering it down into the well again. The main reason is that some twisting builds up in the drill string. The twist causes powerful torque to be applied on the assembly. The lower part of the known assembly is mounted so as to be rotatable to a certain degree, but it also conducts a number of hoses for hydraulic fluid and air from the fixed part of the device to the rotatable part, which means that because of the torque that occurs during a trip, all of these hoses have to be disconnected. Other disadvantages are also present if this prior art assembly is used for tripping the drill string, because the equipment is not constructed with this function in mind. Therefore, tripping is performed in the conventional manner. Another important drawback is that any change of the conical screw connections between the pipes has to be effected by moving the entire drawworks in the vertical direction, resulting in a high risk of damaging the threads.

The object of the present invention is to provide a drilling assembly of the type recited above which does not have the above-mentioned drawbacks, and which is constructed for performing the tripping function and thus is admirably suited for this, as well as having a number of other advantages.

This is obtained according to the invention by a well drilling assembly of the above-recited type which is characterized in that the shaft connected to the rotary device is telescopic, that outside the shaft a lifting means is provided for the lower part of the telescopic shaft, and that the two hangers or links which carry the clamping/lifting device for the pipe, known as the elevator, are axially movable in relation to the telescopic shaft, being attached thereto by means of a slideable holder known as a link hanger.

Other features of the invention are disclosed in the subsidiary claims.

The invention will be described in greater detail in the following with reference to the accompanying drawings, which show a preferred embodiment of the invention.

Figure 1:
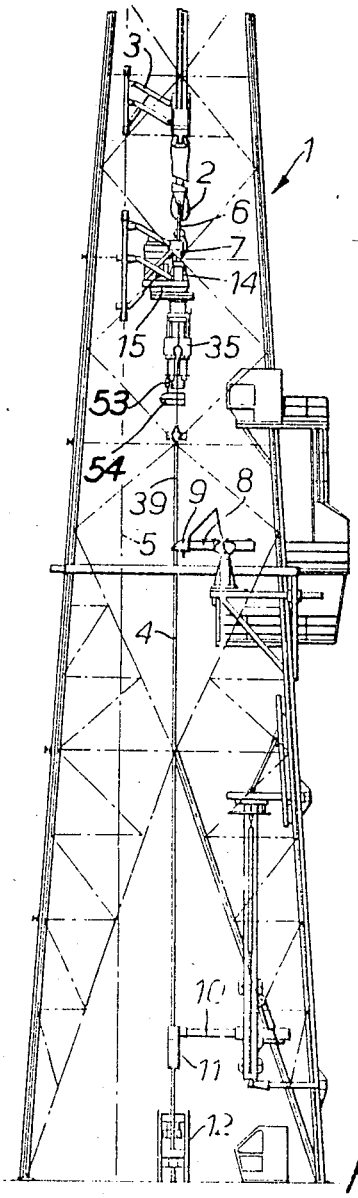
FIG. 1 shows a portion of a derrick provided with the well drilling assembly of the invention.
Figure 2:
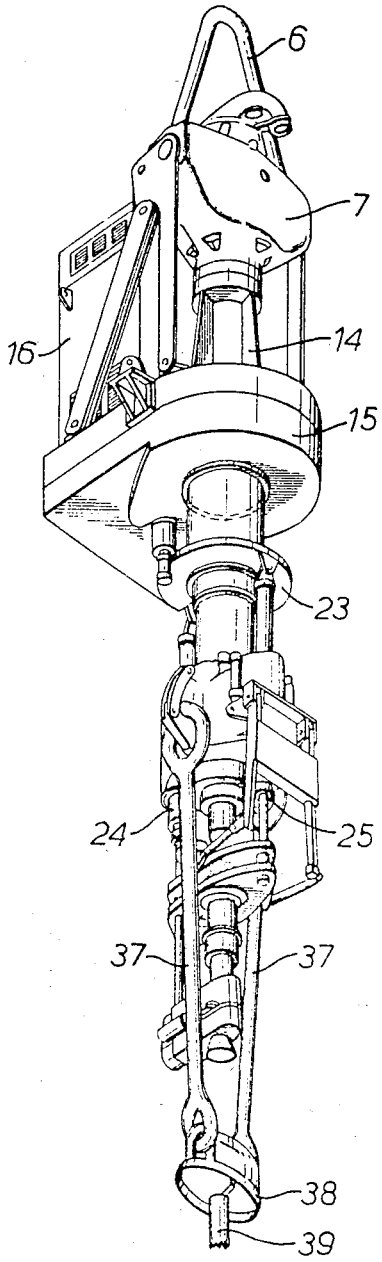
FIG. 2 is an isometric drawing of the assembly of the invention.
Figure 3:
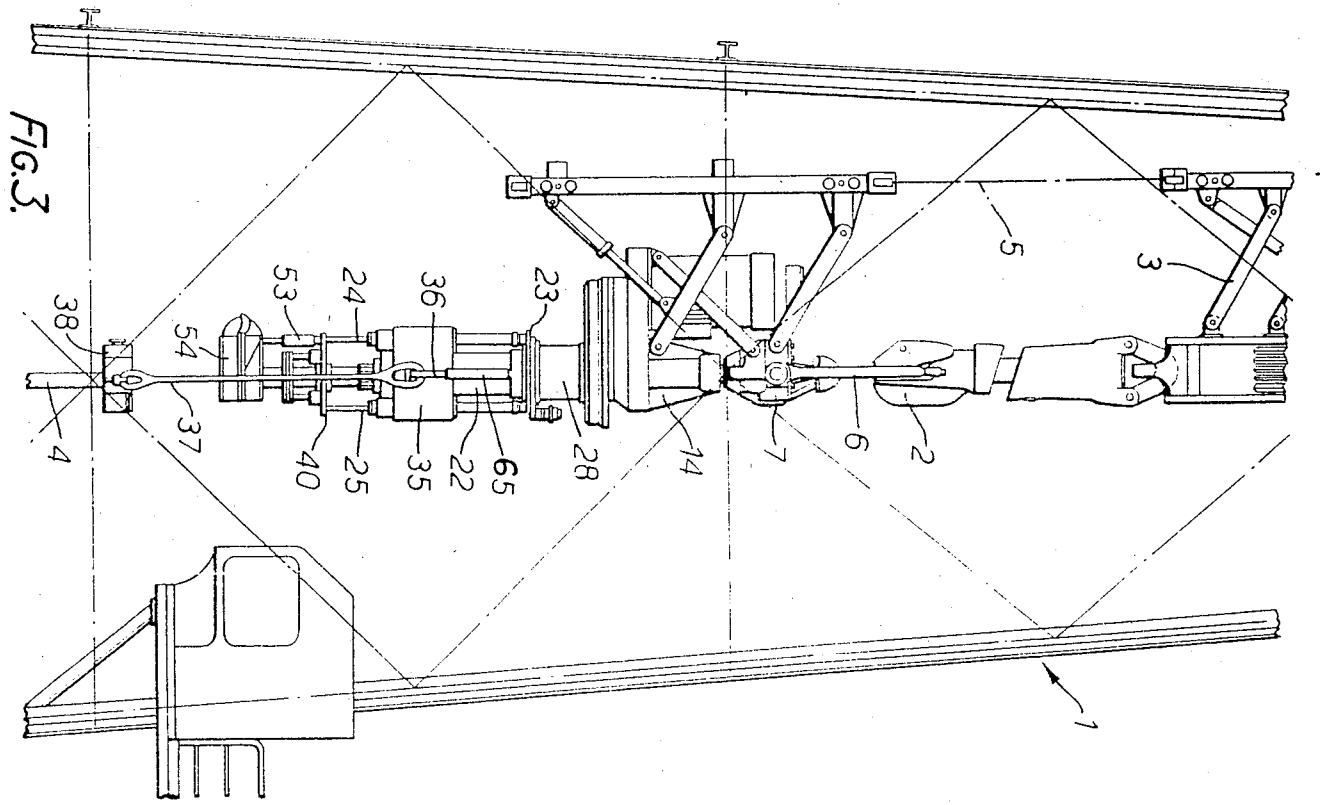
FIG. 3 shows a simplified sketch of the well drilling assembly suspended from the hoist hook within the derrick.

On an oil derrick 1, a crane hook 2 can be moved vertically by means of a drawworks, which is not illustrated in the drawing. With the aid of parallel arms 3, the hook can also be moved in the lateral direction, and be guided vertically alongside the line of drilling 4 along rails 5. Via a link 6, a drilling mud swivel 7 is suspended from the crane hook, for supplying drilling mud to the drill string 39. Inside the derrick frame, an upper grab tool 9 with a grab head 9' together with a lower grab arm 10 with a rotatable grab head 11 can move a section of drill pipe, known as a stand, from the line of drilling 4 to a rack on the derrick, and return the stand of pipe to the well, which is known as a trip. Down on the rig floor a device 12 known as an iron roughneck is provided, which consists of a torque wrench and a spinner which rotates the drill pipe, applying sufficient force to screw and unscrew the lengths of drill pipe.

Figures 4, 4A:
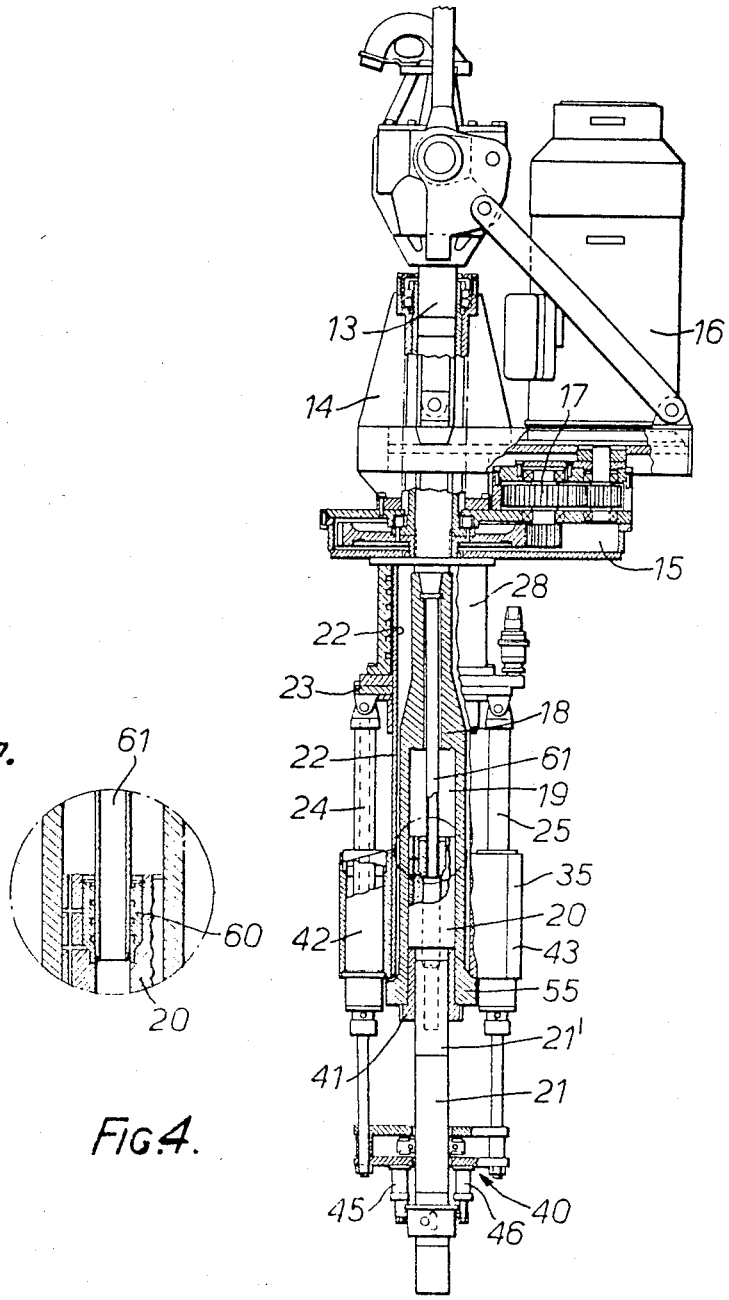
FIG. 4 shows a part of the drilling assembly in partial cross section.
FIG. 4A is a fragmentary view, on an enlarged scale, of a part of FIG. 4.
Figure 5:
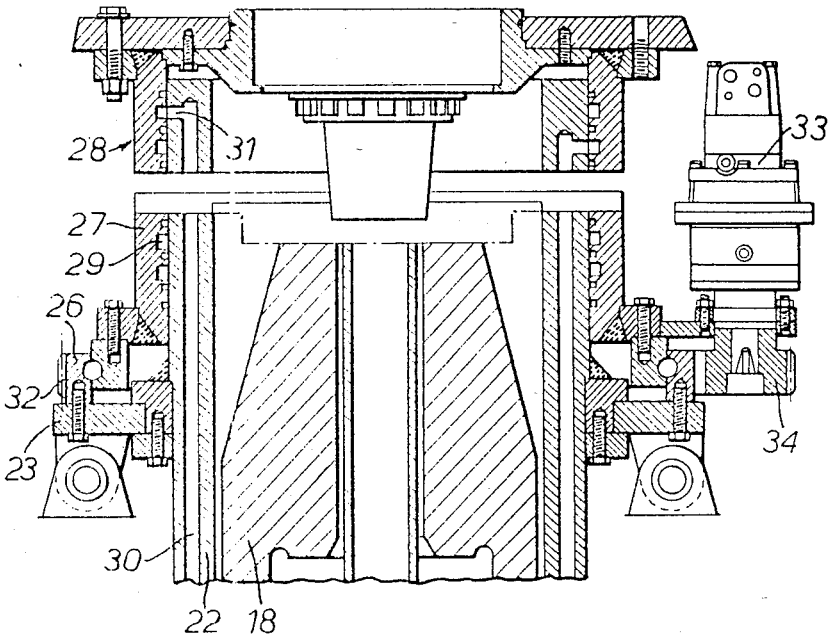
FIG. 5 shows a detail of the drilling assembly in vertical section.

On the assembly according to the invention, shaft 13 (see FIG. 4) is provided below the swivel 7, which freely rotates in the swivel. For practical reasons, the shaft is divided into a plurality of detachable parts, known as subs. The shaft 13 is rotatably mounted within a support means 14 to which a gear box 15 is rigidly attached. A powerful rotary motor 16 is mounted on the gear box, which via a transmission gear 17 drives the shaft 13. The gear box can be blocked by a pawl (not shown).

The shaft 13 has an expanded section 18 with an internal, central guide chamber 19 within which a guide piston 20 can move freely. The lower end of the piston 20 carries a shaft pin 21 which extends outwardly from the expanded section 18. In this way, a telescopic shaft is provided, as the shaft pin 21 can be moved in and out of the expanded section 18. The entire shaft 13 including the expanded section and the telescoping pin 21 has a central bore to permit the flow of drilling mud from the drilling mud swivel to the drill pipe. For this reason, the guide piston 20 is provided with a packing box 60, and a centrally disposed pipe 61 extends from the wider section 18 of the shaft into the packing box and can telescope into the guide piston 20. The flow path for the drilling mud is thus liquid-tight. Outside the wider section 18 of the shaft 13, there is a rotatable sleeve 22. Hydraulic cylinders 24 and 25 are attached to an annular flange 23 outside the sleeve 22.

Via a support means 26, the sleeve 22 is rotatably suspended from a skirt 27 which is fastened beneath the gear box 15. The upper part of the sleeve 22 together with the skirt 27 form a so-called air/hydraulic fluid swivel 28. Compressed air or hydraulic fluid is supplied to a number of separate annular grooves 29 on the interior of the skirt 27. These grooves correspond to a plurality of axial channels 30 above a transverse passage 31. In this manner, working medium is transferred from the stationary part of the assembly that hangs from the crane hook to the rotatable part without the use of hoses. Therefore, the lower part of the assembly can rotate freely relative to the upper, stationary part. The annular flange 23 is provided with a gear wheel 32 which is driven by a motor 33 via a pinion 34. The purpose of this will be explained below.

Outside the sleeve 22, an axially movable holder 35, called a link hanger, is provided. Suspended from lugs on the hanger are struts or links 37 which carry a clamping/lifting means known as the elevator 38. The elevator is a device which has a central bore shaped to conform the upper part of a drill pipe. The elevator can be divided so that it can then be inserted over the upper end of a drill pipe 39.

Figure 6:
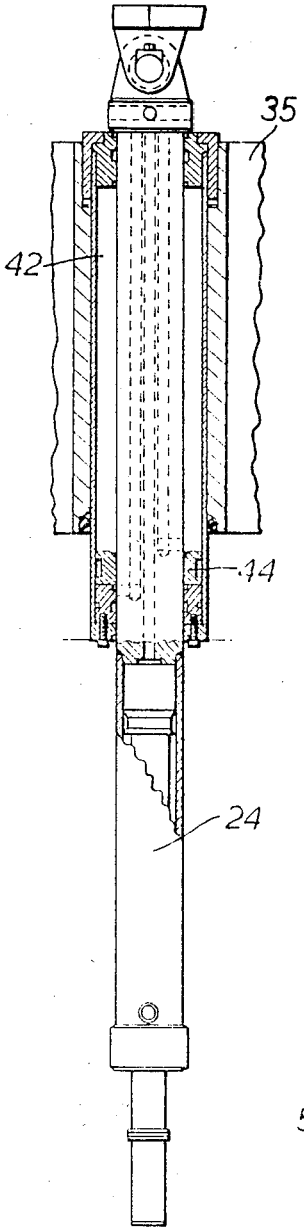
FIG. 6 is a more detailed illustration of the hydraulic lifting assembly.

As mentioned above, hydraulic cylinders 24 and 25 are mounted on the annular flange 23. Attached to the ends of the cylinders is a support means 40. By means of this support, the shaft pin 21 can be guided into and out of the wider section 18 of the shaft 13 through the action of the guide piston 20. A section 21' of the pin 21 is provided with feather keys or splines which slide in complementary grooves in a nut 41 which is screwed into the lower end of the wider section 18 of the shaft 13. By means of the spline, the moment of rotation is transferred from the wider section 18 to the outwardly moving pin 21. The hydraulic cylinders 24 and 25 constitute the piston rods of hydraulic cylinders 42 and 43, which are arranged on the link hanger 35. In FIG. 6, the link hanger 35 is shown raised into its upper position. It is obvious that if hydraulic fluid is guided over the piston 44, the link hanger 35 will be pressed upwardly along the smooth external cylinder 24, which functions as a stationary piston rod. In this manner, the link hanger 35 is moved upwardly. The link hanger will automatically fall into its lower position by its own weight.

Figure 8:
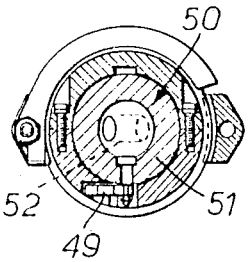
FIG. 8 is a cross section along the line VIII—VIII in FIG. 7.

Below the supporting ring 40, two hydraulic cylinders 45 and 46 are provided. The piston rods 45' and 46' are attached to an axially sliding sleeve 47, with a guide channel 48 which operates a handle 49 for an internal blow-out preventer, the IBOP 50, as clearly seen in FIG. 8. This consists of a rotatable, spherical body 52 with a through bore 51. Through the operation of the handle 49, the sphere is rotated for opening or closing off the through passage in the drill string, in the same manner as a conventional two-way cock. Attached to the lower side of the support 40, via a strut member 53, is a pipe breakout member 54, known as a torque wrench.

The link hanger is non-rotatably connected to the sleeve 22, as this is provided with a massive external spline 55, and the internal bore of the link hanger is provided with corresponding key grooves.

The invention works in the following manner during drilling:

Through the action of the rotary motor 33 via the pinion 34, gear wheel 32, sleeve 22, link hanger 35 and links 37, the elevator 38 is set in the correct angular position for receiving a length of drill pipe. The hook 2 with the entire drilling assembly is guided into an upper position, as shown in FIG. 1. By means of the pipe handling equipment 8,9,10, 11, a pipe is guided into the line of drilling and into the open elevator, while at the same time the handling system lowers the pipe into the upper coupling on the last pipe on the drill string, which is fixedly held in position at the rig floor in retaining means called slips.

Thereafter, the entire drilling assembly is lowered so that the telescopic shaft pin stabs the upper end of the pipe. The shaft 13 is then turned by means of the rotary motor 16, and the threads are screwed in. The pipe breaker 54 then screws on the upper coupling and tightens it sufficiently, and the iron roughneck tightens the lower coupling.

When the drill pipe is to be pulled out of the well during a trip, a stand of pipe is hoisted up from the well and held in a fixed position by the slips. The stand, consisting of three lengths of pipe, is then detached from the rest of the drill string at the rig floor level by means of the breakout tool on the iron roughneck. A rotary tool called a spinner on the iron roughneck turns the stand of pipe so that the entire coupling is released. During this operation, the elevator 38 has been guided a short distance downwardly, so that the upper end of the stand of pipe can rotate freely in relation to the elevator. The stand of pipe, which is now detached, is clamped by the grab tools 8 and 10 and transported to the pipe rack. When the pipe is being hoisted up, the entire drill string is suspended from the rotary device, because the link hanger 35 is retained by shoulders on the expanded section 18 of the shaft 13. The hydraulic cylinders 42 and 43 act like springs. The hydraulic oil then flows over a circuit with an adjustable valve, so that at a predetermined load on the links 37, the oil will bleed out from the upper chamber in the hydraulic cylinders via the piston 44, and the link hangers 35 will therefore be pulled down such that their lower edge rests against an extremely massive shoulder 55 on the expanded section 18 of the shaft 13. In this way, the weight of the entire drill string is transferred to the crane hook.

As mentioned above, a rather high degree of spin or twist may be imparted to the drill pipe owing to the nature of the well itself. This torque can be taken up without problems by the assembly because the link hanger 35 can rotate freely on the rotary device. If the drill pipe sticks as it is being pulled out, the pipe must be made to rotate and mud must be pumped down into the well. This is done by coupling the outwardly extending pin on the shaft to the upper part of the drill string, so that the entire weight of the drill string now hangs in the normal manner from the assembly as it does during drilling, except that the drill string is now being hoisted up while being rotated instead of being lowered down into the well.

The assembly of the invention comprises two separate, independently movable systems. The cylinders 24 and 25 can move the pin 21 in and out, and can thus shorten or extend the shaft length 13. By means of the external hydraulic cylinders 42 and 43, the link hanger 35 can be moved independently up and down on the sleeve 22, i.e., moved independently in relation to the shaft 13, and thus the elevator 38 can also be moved up and down independently of the shaft 13.

Figure 7:
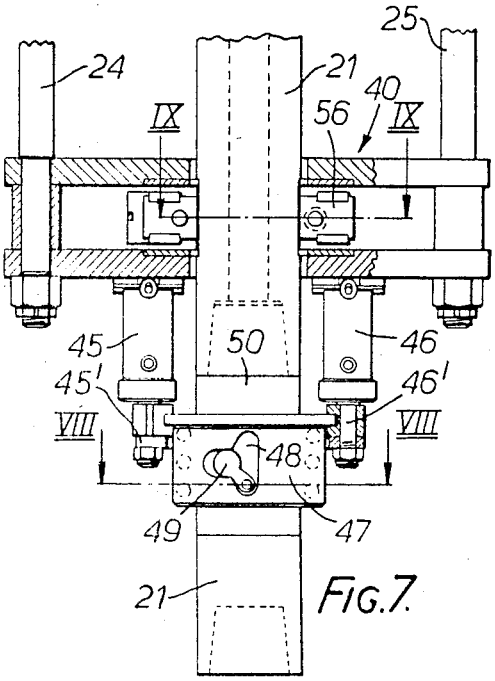
FIG. 7 shows another detail of the drilling assembly in partial cross section.
Figure 9:
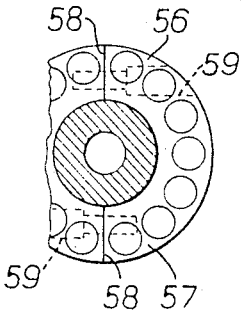
FIG. 9 is a cross section along the line IX—IX in FIG. 7.

The bearing in the support means 40 consists of a parallel bearing 56, as seen in FIG. 7 and especially in FIG. 9. The parallel bearing is attached to the shaft in such manner that it has high inertial resistance both to rotation and to axial movement in relation to the shaft. As seen in FIG. 9, the bearing ring 57 is divided diametrically at 58. The two rim members are held together by bolts 59 indicated by broken lines in FIG. 9. The object of being able to separate the bearing is to enable the piston rods on the hydraulic cylinders 24 and 25 to be moved upwardly without drawing the pin 21 along with them. To be able to do this, the handle 49 for operating the valve body 51 in the IBOP 50 must be removed. The sleeve 47 with the guide channel 48 can then slide outside the IBOP. The purpose of this is to permit maintenance work on the IBOP or to allow a check valve to be introduced into the drill string. The hydraulic cylinders 24,25 are drawn up high enough that the pipe breakout member 54 can break loose the upper coupling for the IBOP. This provides sufficient access for overhauling or replacing the IBOP.

If the driller, during a trip, notices that the well is out of balance, the shaft 13 can at any time be stabbed into the drill pipe and the IBOP can be closed by remote control. A check valve with barbs is then inserted into the drill string through the opening 52 in the valve body 51 in the IBOP after this has been opened just long enough to allow the valve to be guided down into the drill string. The IBOP is then immediately reconnected to the pin 21. When drilling mud is subsequently pumped down into the pipe, the check valve will be forced downwardly in the pipe. A trip to get the drill bit down at the bottom of the well can then commence.

Having described my invention, I claim:

1. A well drilling assembly of the type in which a rotary device is suspendable by a hook of a derrick hoisting means, to which rotary device, a hollow shaft assembly is connected having a threaded end which is adapted to be coupled to the end of a drill string, which has complementary threads, and wherein a drill pipe elevator is suspended below the rotary device by two links, characterized in that the hollow shaft assembly includes an expanded section and a shaft pin which is telescopic relative to the expanded section, that externally of the hollow shaft assembly there is lifting means for moving the shaft pin telescopically relative to the expanded section, and that the elevator is suspended by two links and is axially movable in relation to the hollow shaft assembly by means of a slidable link hanger.

2. An assembly according to claim 1 including hydraulic cylinders for moving the link hanger.

3. An assembly according to claim 2 wherein the lifting means for the shaft pin of the telescopic hollow shaft assembly includes hydraulic cylinders.

4. An assembly according to claim 3, characterized in that the hydraulic cylinders are constructed as a unit having internal cylinders constituting piston rods for outer hydraulic cylinders.

5. An assembly according to claim 4, characterized in that the piston rods of the hydraulic cylinders are attached by a bearing cage of a thrust bearing to the shaft pin of the hollow shaft assembly, and that attached to the underside of the bearing cage are two hydraulic cylinders connected to a slidable sleeve for moving said sleeve axially on the shaft pin, said sleeve having a guide channel engaging with a handle connected to an internal blow-out preventer.

6. An assembly according to claim 5, characterized in that a torque wrench is fastened by strut members below the bearing cage.

7. An assembly according to claim 6, characterized in that the thrust bearing is a sliding bearing which is fastened with high inertial resistance to rotation and to axial movement to the shaft pin, said bearing cage being freely movable relative to the shaft pin, and that the bearing is diametrically dividable so that it can be disengaged from the pin in order that the piston rods can thereby move the bearing cage and thus the sleeve freely on the pin after the handle has been removed, for the purpose of bringing the torque wrench up to the upper joint of the internal blow-out preventer.

8. An assembly according to claim 5, characterized in that the link hanger is attached non rotatable to the outside of the sleeve by means of a key groove and spline.

9. An assembly according to claim 1, characterized in that the expanded section of the shaft assembly defines a central internal cavity in which a shaft head moves, said shaft head supporting the outwardly projecting shaft pin in such a manner that the shaft pin is non rotatable in relation to the expanded section, the shaft pin being provided with splines.

10. An assembly according to claim 1 including means for transferring compressed air and hydraulic fluid from a stationary section of the assembly to the rotatable section by means of an air/hydraulic fluid swivel, thereby avoiding the use of hoses.

11. An assembly according to claim 3, characterized in that the hydraulic cylinders are suspended in articulated fashion from an annular flange which is fastened non rotatable in relation to a sleeve to which it is attached, that the annular flange is attached by a bearing to a skirt which is rigidly attached to a stationary part of the rotary device, and that a gear wheel is provided in connection with the annular flange, engaging with a pinion that is turned by a motor.

* * * * *